United States Patent [19]

Warnock

[11] 4,451,153

[45] May 29, 1984

[54] APPARATUS FOR BLENDING AND DISPENSING A MIXTURE OF ASPHALT EMULSION AND SAND

[76] Inventor: Denny F. Warnock, 6100 W. Stonehedge, Greenfield, Wis. 53220

[21] Appl. No.: 280,319

[22] Filed: Jul. 6, 1981

[51] Int. Cl.[3] ..... B28C 5/38

[52] U.S. Cl. ..... 366/13; 366/65; 366/102; 366/177; 366/182

[58] Field of Search ..... 222/135, 626, 637; 366/13, 16, 21, 27, 34, 37, 40, 41, 53, 102, 107, 168, 177, 179, 182, 279, 65; 414/332, 498, 919

[56] References Cited

U.S. PATENT DOCUMENTS

| | | | |
|---|---|---|---|
| 1,646,582 | 10/1927 | Halliburton | 366/16 |
| 1,969,533 | 8/1934 | Pipes et al. | 366/16 |
| 2,147,053 | 2/1939 | Owsley | 366/13 X |
| 3,036,707 | 5/1962 | Walden | 209/643 |
| 3,100,064 | 8/1963 | Kacena | 366/53 X |
| 3,141,656 | 7/1964 | De Wijn | 366/314 |
| 4,410,280 | 10/1983 | Yamauchi | 366/314 |

*Primary Examiner*—Philip R. Coe
*Assistant Examiner*—Arthur D. Dahlberg

[57] ABSTRACT

Truck-transportable manually positionable apparatus for blending and dispensing a mixture of liquid asphalt emulsion and sand to fill cracks in pavement includes a support on which a sand hopper and blending/dispensing device are mounted. The device includes a housing having a rotatable sand impeller therein driven by a pneumatic motor and having a valved sand inlet port above the impeller, a pressurized air inlet port between the sand port and impeller (supplied from the same source as the motor), a mixture outlet port below the impeller, and a valved emulsion inlet port between the impeller and mixture outlet port. Gravity fed sand from the hopper is forcably propelled through the housing of the device toward the mixture outlet by the impeller and compressed air, and is mixed with emulsion just prior to exiting the mixture outlet port.

1 Claim, 10 Drawing Figures

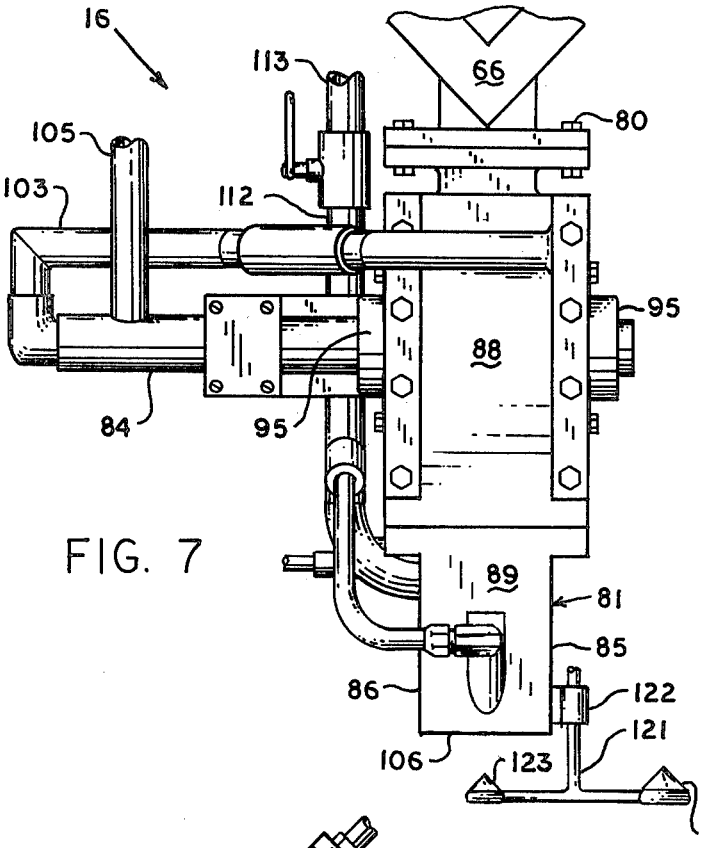
FIG. 7
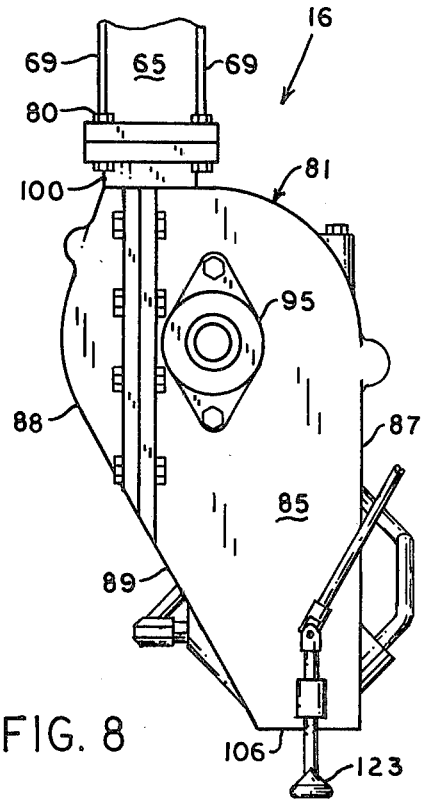
FIG. 8
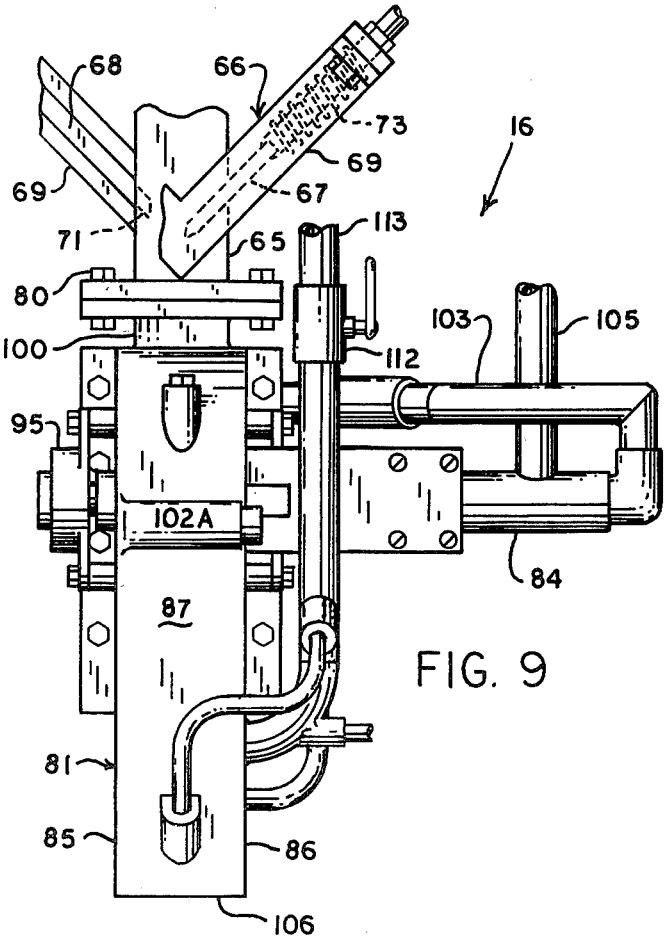
FIG. 9
FIG. 10
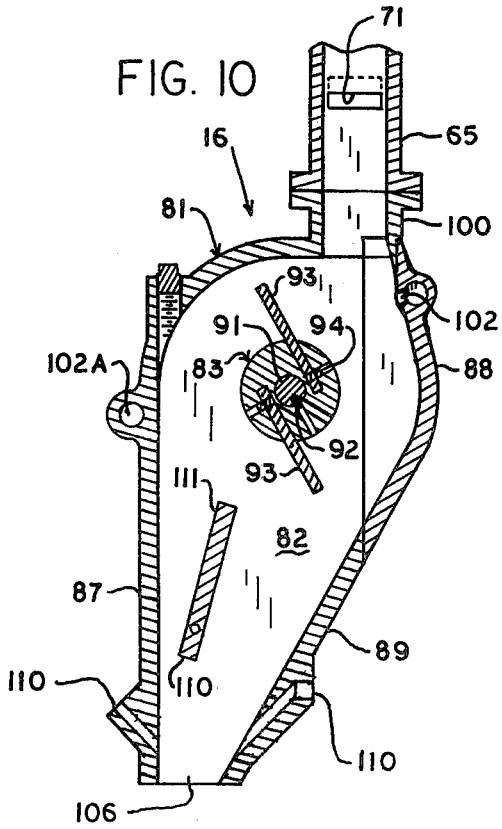

APPARATUS FOR BLENDING AND DISPENSING A MIXTURE OF ASPHALT EMULSION AND SAND

BACKGROUND OF THE INVENTION

1. Field of Use

This invention relates generally to apparatus and devices for blending and dispensing a mixture of liquid asphalt emulsion and and to fill cracks in pavement.

2. Description of the Prior Art

Heretofore it has been the practice to repair and fill cracks in asphalt or concrete pavement by first filling the crack with liquid asphalt emulsion expelled under pressure from a wand (or merely poured in a stream from a can) and then sprinkling, spreading or sweeping dry sand over the exposed upper surface of the emulsion. This procedure is unsatisfactory because the crack is filled with relatively expensive emulsion, rather than a less expensive homogeneous mixture. Apparatus has been developed to blend and dispense a mixture of emulsion and sand to overcome the aforesaid problem but such prior art apparatus is so constructed that mixing is accomplished by a blade acting upon the sand and emulsion and occurs so far therewithin that the apparatus is prone to clogging and difficult and time-consuming to clean after use, thereby negating any cost-savings or other efficiencies.

SUMMARY OF THE PRESENT INVENTION

In accordance with the present invention there is provided an improved truck-transportable mobile apparatus for blending and dispensing a mixture of liquid asphalt emulsion and sand to fill cracks in pavement. The apparatus comprises a mobile support including a first framework having wheels thereon and a second framework adjustably mounted on the first framework. A sand hopper is mounted on the second framework and comprises a sand outlet port and a manually controllable valve for controlling sand flow from the sand outlet port. A blending and dispensing device is mounted below the sand hopper and comprises a housing having a rotatable impeller therein and a sand inlet port in said housing above said impeller, a pressurized gas inlet port in said housing between said sand inlet port and said impeller; a mixture outlet port in said housing below said impeller, and emulsion inlet ports in said housing below said impeller and above said mixture outlet port. A manually controllable valve is provided for controlling emulsion flow to the emulsion port. A pneumatic motor is mounted on the device for driving the impeller. A circuit is provided to supply compressed gas to the gas inlet port also drives the pneumatic motor. The mobile support includes a lifting frame pivotably connected to the first framework for engagement with a pivotable dump body of a truck whereby said apparatus can be self-loaded and self-unloaded at a job site by the truck.

Apparatus and a device in accordance with the invention offers several advantages over the prior art. For example, the emulsion and sand are thoroughly mixed prior to application to a crack, thereby providing a better and cheaper crack-filling material. Furthermore, the mixture is supplied to the crack under pressure thereby resulting in deeper and more complete penetration. The mixing of sand and emulsion takes place within the housing of the device only near the mixture outlet port and no sticky, messy emulsion ever reaches the blade. Thus, the device does not tend to clog during operation and is easy to clean after use. Valve means enable the sand/emulsion ratio to be varied as desired thereby providing a mixture of whatever consistency is required for particular jobs. The mobility of the apparatus as it is pushed along by the operator and the further manual positionability of that portion of the framework on which the device is directly mounted ensures efficient and complete patching coverage of heavily cracked or crazed surfaces. The lifting frame portion of the framework enables the apparatus to be self-loaded or self-unloaded at a job site thereby faciliting and reducing the cost of the patching work. The apparatus and device are relatively simple, straight-forward and rugged in construction and economical to manufacture and use. Other objects and advantages of the invention will hereinafter appear.

DRAWINGS

FIGS. 7, 8, 9 and 10 are enlarged front, side, rear and opposite side elevation views of the blending and dispensing device.

DESCRIPTION OF A PREFERRED EMBODIMENT

Figure 1:
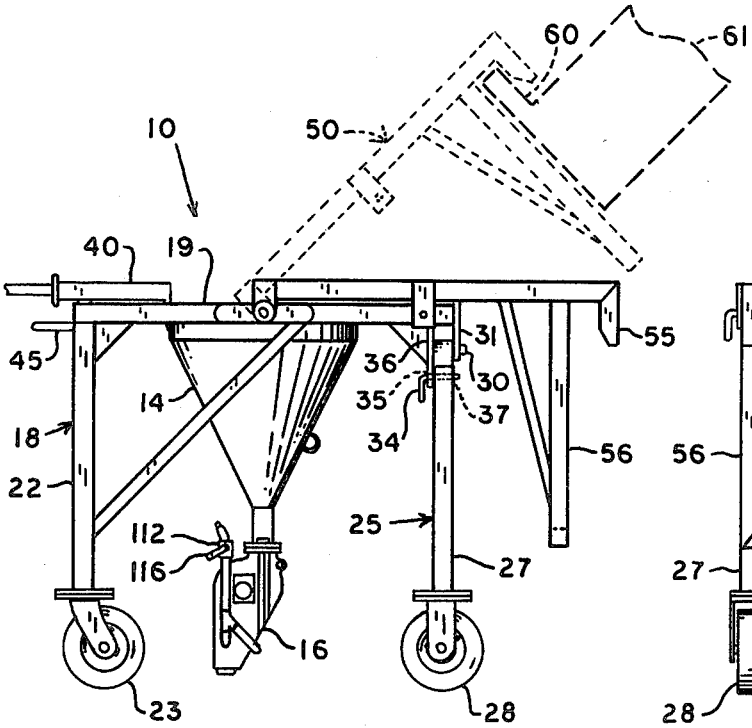
FIG. 1 is an elevational view of one side of blending and dispensing apparatus in accordance with the invention.
Figure 2:
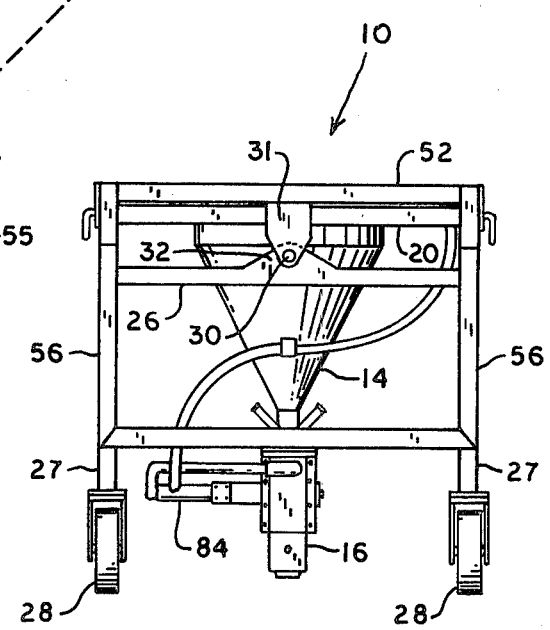
FIG. 2 is a front elevation view of the apparatus.
Figure 3:
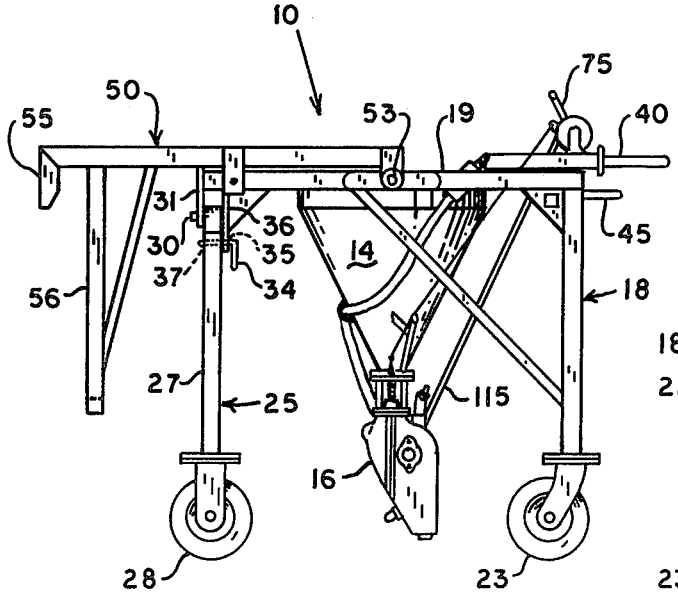
FIG. 3 is an elevation view of the other side of the apparatus.
Figure 4:
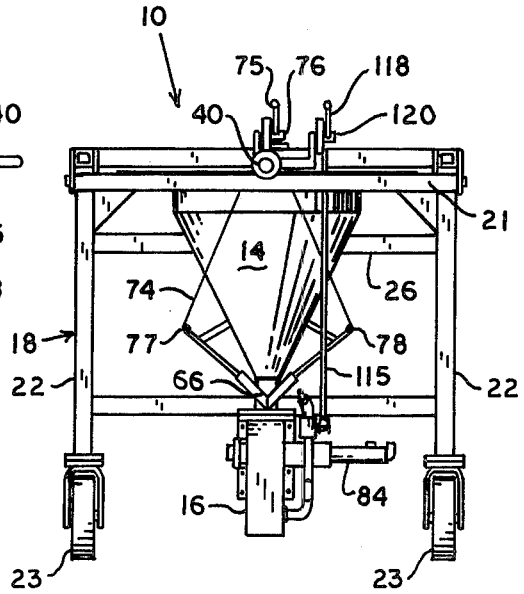
FIG. 4 is a rear elevation view of the apparatus.
Figure 5:
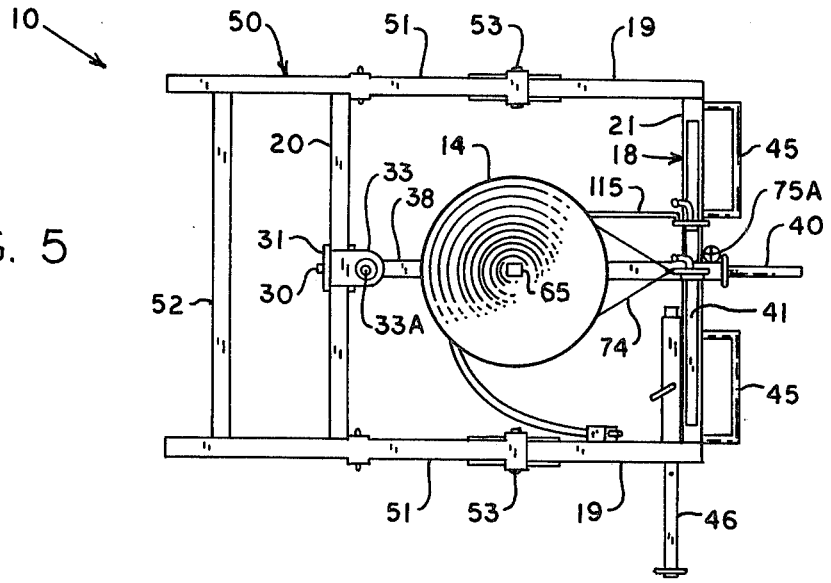
FIG. 5 is a top plan view of the apparatus.

Referring to FIGS. 1 through 5, the numeral 10 designates apparatus for blending and dispensing a mixture of liquid asphalt emulsion and sand. Apparatus 10 is adapted to be self-loaded and unloaded on a dump truck for transport to and from a jobsite and is further adapted, when at a jobsite to be manually pushed by a human operator stationed at the "rear" end thereof over a cracked area of pavement requiring filling and/or patching. For convenience in description, apparatus 10 is designated as having front and rear ends (i.e., right and left sides of FIG. 1).

Generally considered, apparatus 10 comprises a framework 12 on which a sand hopper 14, a blending and dispensing device 16, and other components are mounted or supported. Framework 12 comprises a main or rear frame portion 18 including a pair of side support members 19, a pair of front and rear support members 20 and 21, respectively, and a pair of rear uprights or legs 22 having rear caster wheels 23 pivotably mounted thereon. Framework 12 further comprises a front center portion 25 including a cross member 26 and a pair of forward uprights or legs 27 having front fixed wheels 28 rotatably mounted thereon. Front portion 25 of framework 12 is pivotably connected to main portion 18 by a pivot pin 30 which engages brackets 31 and 32 on front support member 20 and cross member 26, respectively. The axis of pin 30 is horizontal and disposed fore and aft of apparatus 10 and enables rocking motion of the front end of main portion 18 so as to position device 16 relative to cracks. Removable lock pins 34 engageable with holes 35 in tabs 36 on rear portion 18 and with holes 37 in cross member 26 on front portion 25 prevent such rocking motion.

Framework 12 also comprises a bracket 33 rigidly mounted on the middle of front support member 20 which carries a vertically disposed pivot pin 33A on which a pivot member 38 is mounted. Pivot member 38 is rigidly secured as by welding to the front side of the top of sand hopper 14. The rear side of the top of sand hopper 14 is provided with a handle 40 which is rigidly secured thereto as by welding and which rests on a nylon anti-friction surface member 41 which is secured to the top of rear support member 21 of main portion 18 of framework 12. Sand hopper 14 can be swung to various positions relative to the pavement therebeneath by means of handle 40.

The rear end of main frame portion 18 includes push handles 45 and a slideably mounted hose-supporting rod 46 which can be positioned as desired to support (see FIG. 6) an air hose and an emulsion hose from a truck (not shown).

Main frame portion 18 of framework 12 also is provided with a lifting frame 50 by means of which the apparatus 10 can be self-loaded or self-unloaded by a dump truck used to transport the apparatus to and from a job site. Lifting frame 50 comprises a pair of side members 51 which are inter connected near one end by a cross-brace 52 and which have their other ends pivotally connected by pivot pins 53 to points near the middle of the side support members 19 of main frame portion 18. The side members 51 of lifting frame 50 are provided at their said one ends with short downwardly extending projections 55 and with additional longer downwardly extending projections 56 spaced inwardly of the projections 55. The projections 55 and 56 are designed to receive the top edge of a tail gate 60 (see FIG. 1) there between when the transport dump truck dump box 61 is raised and tilted and lifting frame 50 is raised (see FIG. 1). Then, as the dump box 61 is lowered and frame 50 assumes a horizontal (but now raised position) the entire apparatus 10 is raised from the ground.

As previously explained, sand hopper 14 is movably mounted (positionable) on the main frame portion 18 and affords support for the device 16 which is mounted therebelow. Hopper 14, which is conical in shape and open at the top to receive sand, is provided at its lower end with a sand outlet port 65. An adjustably positionable valve or sand flow control means 66 is provided on hopper 14 just above port 65 and such means include a pair of plates or gates 67 which are slidably mounted for movement relative to each other at a 90° angle in grooves 68 on a pair of gate support brackets 69 rigidly secured at the lower end of hopper 14. Each gate 67 is slidably movable toward the other toward closed position in an opening 71 in the neck of hopper 14 by means of a tension-type biasing spring 73 which is connected between the gate and the hopper. Each gate 67 is slidably movable away from the other toward open position by means of a cable 74 which has one end connected to the gate and has its other end connected to a pivotably movable sand flow control lever 75 on hopper handle 40. Lever 75 can be locked in desired position by tightening nut 76. Each cable 74 is reeved around guide pulleys 77, 78. Lever 75 can automatically be placed or thrown into any one of four preset positions (thereby quickly ensuring proper lever placement) by means of four-position stop member 75A located on handle 40. Stop member 75A rotates to present surfaces of different heights against which lever 75 can rest.

As FIGS. 6 through 10 best show, the blending and dispensing device 16, which is rigidly secured to the lower end of hopper 14 by bolts 80, comprises a housing 81 having a chamber 82 therein in which a sand impeller 83 is rotatably mounted, such impeller being rotatably driven about a horizontal axis by a pneumatic motor 84 mounted on the exterior of housing 81. A baffle plate 111 is also disposed in chamber 82, as hereinafter described. Housing 81 is defined by a pair of laterally spaced apart flat metal side plate 85 and 86 and by edge plates 87, 88 and 89. Impeller 83 comprises a hub 90 secured to a drive shaft 91 by a set screw 92 and having a pair of flat blades 93 affized to the hub by screws 94. Drive shaft 91 is mounted for rotation on anti-friction bearings 95 on the side plates 85 and 86 of housing 81 and extends from the housing on one side for driving engagement with the drive shaft 96 of motor 84. The ends of impeller 83 are spaced from the side plates 85 and 86 of housing to prevent sand build-up therebetween. The edges of the impeller blades 93 are also spaced from the housing edge plates 87, 88, and 89 to allow sand flow therepast and also clear baffle plate 111 by a distance sufficient allow easy sand flow therebetween.

Figure 6:
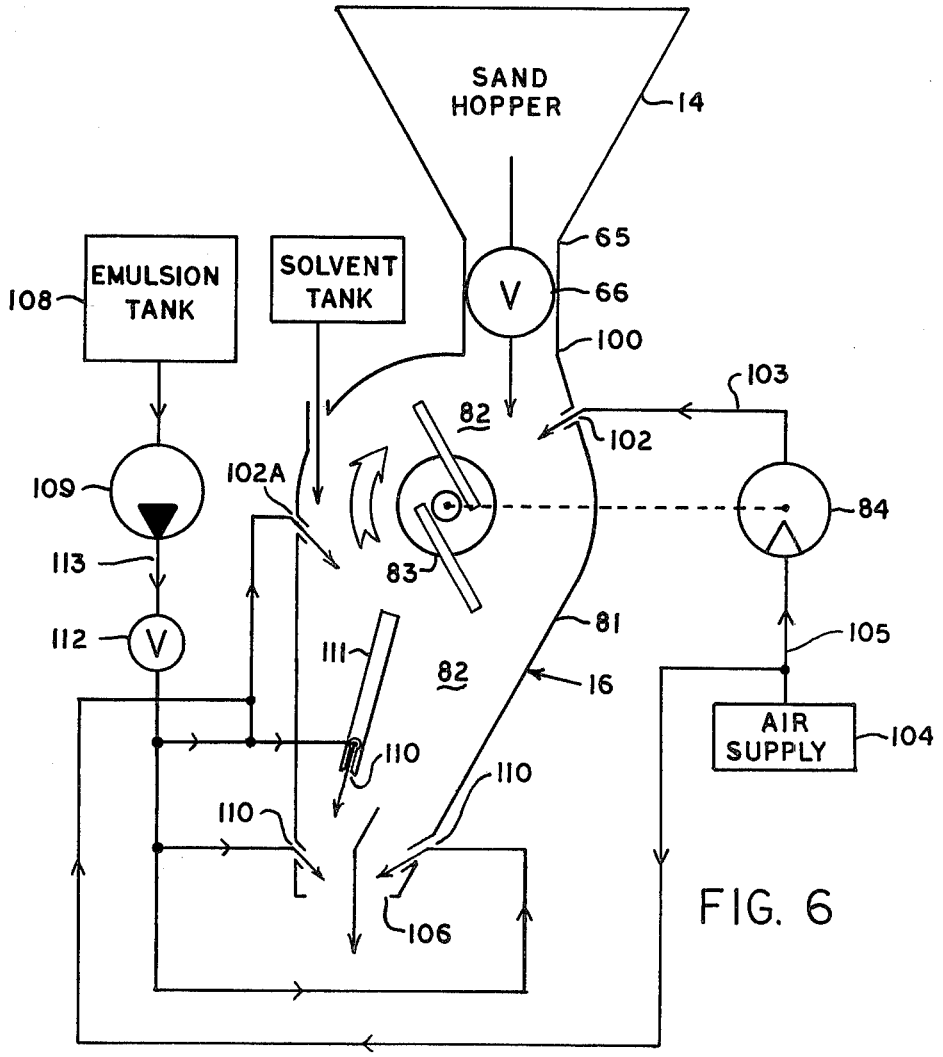
FIG. 6 is a schematic diagram of the inputs to the blending and dispensing device of the apparatus.

As FIG. 6 shows, a sand inlet port 100 is provided in the upper end of housing 81 into chamber 82 above impeller 83 and is connected to receive sand by gravity feed from outlet port 65 of sand hopper 14 when the sand flow control valve 66 is partially or fully open. A pressurized gas (air) inlet port 102 is provided in housing 81 into chamber 82 between port 100 and impeller 83 and receives compressed air from the compressed air motor 84 through line 103 of motor 84. Another air inlet port 102A is provided in housing 81 near the other side of impeller 8 and is supplied from air source 104. Air is also supplied to the emulsion supply line to port 110 in plate 111. Air source 104 may be a compressor or storage tank on the dump truck (not shown). A mixture outlet port 106 is provided in housing 81 leading from chamber 82 below impeller 83 through which the mixture of sand and asphalt emulsion is forcefully expelled as a result of the action of impeller 83, compressed gas entering chamber 82 through port 102, and pressurized emulsion. A plurality of emulsion inlet ports 110 are provided in housing 81 into chamber 82 between impeller 83 and the mixture outlet port 106 and receive pressurized emulsion from a source 108 through a pump 109 located on the dump truck (not shown) through a fluid line 113.

An adjustably positionable valve or emulsion flow control means 112 is provided in fluid line 113 and is movable between open and closed position or any position therebetween by means of a push-pull rod 115 which has one end connected to a lever 116 on the valve stem of valve 112 and has its other end connected to a pivotably movable emulsion flow control level 118 on hopper handle 40. Lever 118 can be locked in desired position by tightening nut 120. The ports 110 are located in baffle 111 and in the housing wall 89.

Device 16 is provided with a T-shaped member 121 which is pivotably and vertically adjustably mounted thereon by a bracket 122 and which is swingable to a position beneath mixture outlet port 106 wherein a small cone 123A or 123 on member 121 interferes with the mixture flow from port 106 and causes it to spray outwardly laterally in a wider pattern than would otherwise be the case.

The apparatus 10 operates as follows. Assume that hopper 14 is filled with sand, that air supply line 105 is connected to air source 104 so that motor 84 and impeller 83 are rotating, that emulsion supply line 113 is connected to emulsion source 108, that sand valve 66 and emulsion valve 112 are both closed, and that the operator has positioned the apparatus 10 and device 16 in desired locations relative to cracks in the surface being treated.

When sand valve 66 and emulsion valve 112 are each opened to a desired degree, sand entering chamber 82 by gravity through port 65 from hopper 14 strikes impeller 83 and is flung downwardly thereby toward and through mixture outlet port 106 being directed in a desired flow path by baffle plate 90A.

Compressed air entering chamber 82 through port 102 prevents sand buildup in chamber 82, especially around impeller 83, and also adds additional force to the sand flow. As the sand passes through emulsion entering chamber 82 through the ports 110 and exiting through mixture outlet port 106, it mixes thoroughly therewith.

The proportion of the sand/emulsion mixture exiting port 106 can be controlled by manipulation of valves 66 and 112. Flow pattern can be controlled by positioning of member 121 or 121A beneath port 106. Device 16 can be position relative to the work surface by manipulation of hopper handle 40 and by tilting of the front end of frame 18 and by rolling the apparatus on its wheels.

When work is completed, the apparatus can be self-loaded on the dump truck (not shown) by means of the lift frame 50.

In an actual embodiment of the invention which was tested and proven satisfactory, device 16 had the following dimensions and operating characteristics.

In device 16, chamber 82 was about 11 inches long and 2 inches wide. Sand inlet port was about 2 inches by 2 inches. Mixture outlet port was about $1\frac{1}{2}$ by 2 inches. Impeller diameter was about $4\frac{1}{2}$ inches. Impeller blade width was about $1\frac{1}{2}$ inches. Baffle plate was about $3\frac{1}{2}$ inches long and 2 inches wide and spaced $\frac{1}{4}$ inch from the impeller.

I claim:

1. Apparatus for blending and dispensing a mixture of liquid asphalt emulsion and sand comprising:

a mobile support including a first framework, a frame portion pivotably connected to said first framework for engagement with a pivotable dump body of a truck whereby said apparatus can be automatically mounted on said truck in raised position for road transport when said dump body is swung from tilted to horizontal position;

ground engaging wheels mounted on said first framework;

a second framework movably mounted on said first framework to enable manual adjustment;

a sand hopper mounted on said second framework and comprising a sand outlet port;

a blending and dispensing device mounted on said second framework below said sand hopper and comprising a housing including a chamber having a rotatable impeller therein and a sand inlet port, an emulsion inlet port, a gas inlet port and a mixture outlet port, each port communicating with said chamber;

valve means for controlling sand flow to said sand inlet port;

valve means for controlling emulsion flow to said emulsion port;

and a motor mounted on said device for driving said impeller.

* * * * *